United States Patent [19]

Schweitzer

[11] 4,029,936

[45] June 14, 1977

[54] IGNITER ASSEMBLY

[75] Inventor: Ronald D. Schweitzer, Mansfield, Ohio

[73] Assignee: The Tappan Company, Mansfield, Ohio

[22] Filed: Jan. 13, 1975

[21] Appl. No.: 540,349

[52] U.S. Cl. ..... 219/267; 219/270

[51] Int. Cl.[2] ..... F23Q 7/00

[58] Field of Search ..... 317/98; 219/260, 261, 219/270; 431/262, 263, 66

[56] References Cited

UNITED STATES PATENTS

| | | | |
|---|---|---|---|
| 2,768,677 | 10/1956 | Traver | 431/263 |
| 2,902,578 | 9/1959 | Johnson et al. | 317/98 |
| 2,912,623 | 11/1959 | Tuttle | 317/98 |
| 3,017,540 | 1/1962 | Lawser | 317/98 |
| 3,139,558 | 6/1964 | Lindberg | 317/98 |
| 3,437,880 | 4/1969 | Profunser | 317/98 |
| 3,488,133 | 1/1970 | Perl | 431/66 |
| 3,512,909 | 5/1970 | Perkings | 317/98 |
| 3,774,077 | 11/1973 | Raffaelli et al. | 317/98 |
| 3,823,345 | 7/1974 | Mitts et al. | 219/261 |
| 3,842,319 | 10/1974 | Perl | 317/98 |

*Primary Examiner*—Bruce A. Reynolds
*Assistant Examiner*—Clifford A. Shaw
*Attorney, Agent, or Firm*—Donnelly, Maky, Renner & Otto

[57] ABSTRACT

An assembly for an electric igniter used principally for the ignition of gaseous fuels includes a mechanical holder and shield for conveniently mounting the igniter in a gas appliance, for example, and for protecting the same from damage. The holder is preferably ceramic and includes a bore within which the igniter is supported and through which electrical leads and terminal tabs extend, and the shield, which surrounds at least substantially all of the high temperature end of the igniter, is attached to the ceramic holder in a facile manner and provides sufficient open passages for effective heat transfer from the igniter to effect ignition of a fuel discharged proximate thereto.

26 Claims, 13 Drawing Figures

IGNITER ASSEMBLY

BACKGROUND OF THE INVENTION

This invention relates to a protective and support assembly, including an electrically non-conductive holder and a shield, for a glow type electric igniter.

A glow type electric igniter is a device which in response to an electrical input generates a thermal output within a temperature range suitable, for example, for the ignition of a fuel, such as natural or artificial gas or the like. Thus, such igniters have utility in ranges, ovens, dryers, furnaces and similar appliances and devices utilizing such a fuel and offer susceptibility to ignition in the manner to be described.

One type of igniter is formed of silicon carbide as disclosed, for example, in U.S. Pat. Nos. 3,372,305 and in 3,397,375. Another type of igniter comprised of molybdenum disilicide is disclosed in U.S. Pat. Nos. 3,488,133 and in 3,823,345. The instant invention will be described in more detail below with reference to an igniter assembly that incorporates an igniter which exhibits the properties of silicon carbide; however, it is intended that the principles of the invention may be applied to igniters which exhibit the properties of molybdenum disilicide as well as to other types of igniters in respect of the material of which the igniter is made.

Several difficulties have been experienced with the silicon carbide and molybdenum disilicide igniters, such as those disclosed in the above-mentioned patents, in the connection of the terminal parts of the igniter to a source of electric energy and in the support of the igniter in a location proximate a gaseous fuel burner, for example, to ignite the fuel therefrom. One problem with such igniters is that the igniters are fragile. Also, in certain applications the igniters are subject to extremely high temperatures, including those generated by the igniter itself as well as those ambient temperatures occurring in the environment within which the igniter is located, and the igniter electrical connections and mechanical supports must be capable of withstanding such high temperatures without damage to the same or the fragile igniter.

One arrangement for connecting electrical leads to the terminals parts of a high temperature gas igniter wherein respective metallized coatings are provided about the respective leads and terminal parts in conductive engagement bonding the same is disclosed in a U.S. patent application for "Gas Igniter," Ser. No. 290,256, Filed Sept. 18, 1972, now U.S. Pat. No. 3,842,319, issued Oct. 15, 1974, which is assigned to the same assignee as the instant application.

Moreover, a shock absorbent support and a protective shield primarily intended for a molybdenum disilicide igniter are disclosed in U.S. Pat. No. 3,823,345. in the latter patent, the support comprises a split housing support through which two terminal strips pass for external crimped connection to the respective terminal parts of the igniter at one end of the housing and for connection to a pair of wires at the other end of the housing, and the shield and housing parts are fastened together by a single screw. Also, in U.S. Pat. No. 3,562,590 an electric igniter wire is attached to a pair of electrodes that are fixedly mounted in a support plug, which is located in a hollow cylindrical casing, and the looped end of the igniter wire protrudes beyond the end of the casing to define an igniting portion for positioning proximate a gas burner.

SUMMARY OF THE INVENTION

In the instant invention an electric relatively high rated igniter to which a pair of electrical leads is attached at a low temperature portion of the same is positioned for support by a ceramic holder. The electrical leads extend down a bore in an otherwise substantially solid holder separated from each other by an electrically non-conductive spacer, and a pair of electrically conductive tab terminals or connectors welded or bonded to the ends of the leads pass beyond the bore outside the holder for external circuit connection to provide electric power to the igniter. The tab terminals and spacer are preferably cemented in permanent position in the holder bore and part of the low temperature inner portion of the igniter also may be cemented in the bore for support by the holder. A protective shield attached to the holder protects the projecting exposed portion of the igniter from physical and electrical shocks while providing adequate open areas or ports for effective heat transfer to a proximate fuel source for ignition by the igniter. Thus, the igniter, leads, terminal tabs, holder, spacer, and shield constitute electrical and mechanical subassemblies of the igniter assembly. In a modified form of the igniter assembly the structure thereof is generally of cylindrical configuration to facilitate manufacture and to reduce the quantity of required materials relative to a rectangular configuration that at present is the preferred form of the invention.

It is, accordingly, a primary object of the invention to provide an igniter assembly improved in the above-noted respects.

Another object of the invention is to provide a holder assembly for a high temperature electric igniter An additional object of the invention is to provide a protective shield for an extending or projecting electric igniter.

A further object of the invention is to provide for the mounting of such an electric igniter in a heating and/or cooking appliance.

Still another object of the invention is to ensure electrical isolation of the leads electrically connected to an electric igniter.

Still an additional object of the invention is to increase the electrical and mechanical integrity of an electric igniter and assembly therefor.

Still a further object of the invention is to conserve materials and to facilitate manufacture of an igniter assembly.

These and other objects and advantages of the instant invention will become more apparent as the description proceeds below.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of one of the various ways in which the principles of the invention may be employed.

DESCRIPTION OF THE PREFERRED EMBODIMENT

Figure 1:
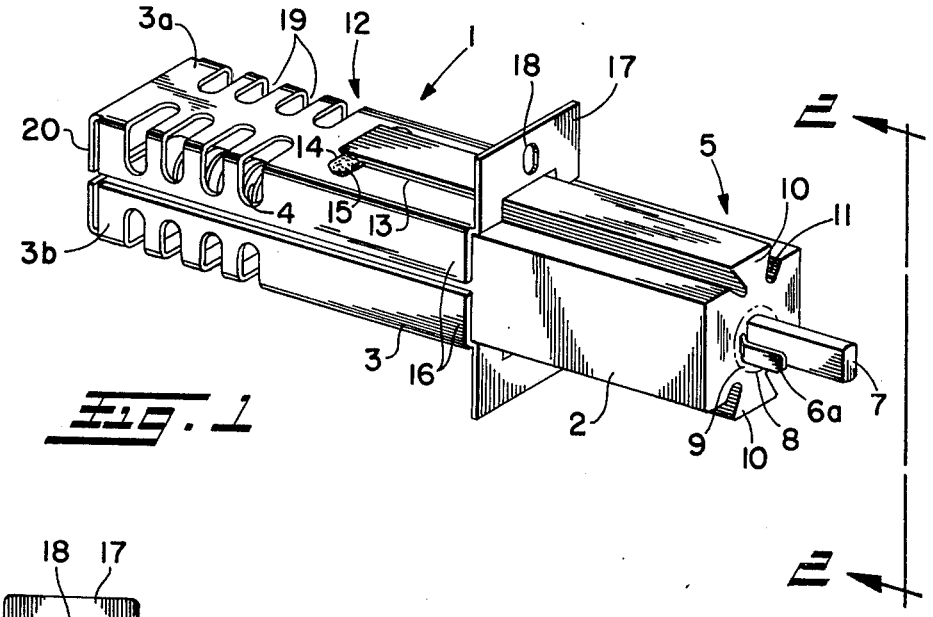
FIG. 1 is an isometric view of an igniter assembly in accordance with the invention.

Referring now more particularly to the drawings, wherein like reference numerals designate like parts in the several figures, an igniter assembly in accordance with the invention is generally indicated at 1 in FIG. 1. The igniter assembly includes a base or holder 2, a shield 3, and a glow type electric igniter 4. As mentioned above, the electric igniter in the igniter assembly of the invention will be described in detail with reference to a silicon carbide type igniter, which may have an overall cylindrical shape with a high temperature portion configured in a double helix, as is disclosed in several of the above noted patents; however, it is intended that the principles of the invention be applied to silicon carbide igniters having different shapes as well as to molybdenum disilicide and other types of incandescent or glow electric igniters. Such electric igniters whenever used should be capable of generating sufficient heat upon energization to ignite a combustible fuel, such as natural or artificial gas or the like.

Figure 2:
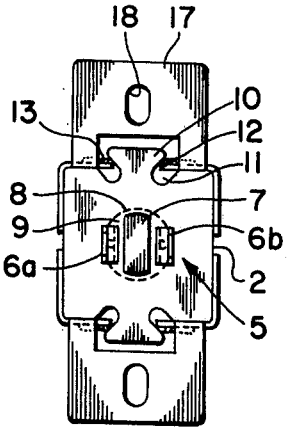
FIG. 2 is an end elevation view of the igniter assembly looking in the direction of the plane indicated by arrows 2—2 of FIG. 1.
Figure 5:
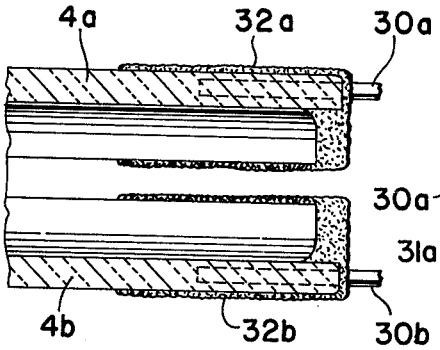
FIG. 5 is an enlarged section view of the low temperature portion of the electric igniter looking in the direction of the plane designated by arrows 5—5 of FIG. 4.
Figure 6:
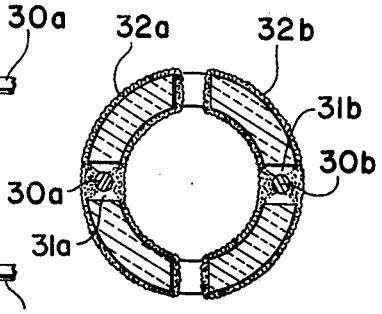
FIG. 6 is a section view of the electric igniter looking in the direction of the plane of the arrows 6 —6 of FIG. 4.
Figure 4:
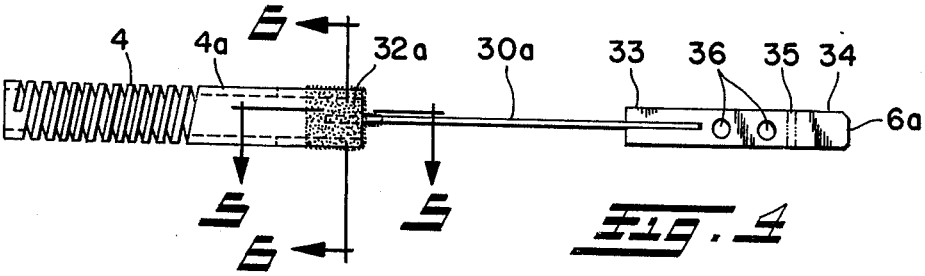
FIG. 4 is an elevation view of an electric igniter, lead connections thereto, and connector tabs illustrating cementing holes through the latter used in the igniter assembly of FIG. 1 and looking in the direction of the plane indicated by the arrows 4 —4 of FIG. 3.
Figure 3:
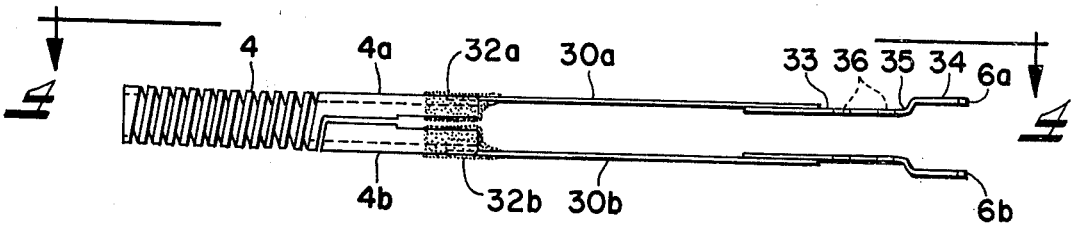
FIG. 3 is an elevation view of an electric igniter, lead connections thereto, and terminal tabs with offsets used in the igniter assembly of FIG. 1.

At the connecting end 5 of the igniter assembly 1 a pair of electrically conductive terminal tabs 6*a*, 6*b*, one being seen in FIG. 1 and both being seen in FIG. 2, provide for connection of the igniter 4 to a source of electric energy. A centrally located elongated insulating spacer member 7, which is preferably formed of a material similar to that of which the holder 2 is formed, ensures electrical isolation of the respective terminal tabs and electrical leads, not shown, that extend through a bore 8 in the holder 2 and connect to respective terminal parts of the igniter 4. The spacer member 7 and terminal tabs 6*a*, 6*b* are preferably cemented in fixed position in the bore 8 by a ceramic insulating cement 9 or by other similar material having compatible characteristics or coefficients with respect to those of the holder and spacer member. The rigidly retained spacer member 7 extends externally of the holder and may function as an alignment key for guidance of at least a portion of the igniter assembly 1 into a receptacle wherein electrical power connections are made to the respective terminal tabs 6*a*, 6*b*, while separating the wire terminals when a receptacle is not used.

The holder 2 is generally of rectangular cross-section with the exception of upper and lower dovetail shape portions 10 on the upper and lower sides thereof to form upper and lower grooves 11. Respective grooves 11 penetrate somewhat below the respective planes of the upper and lower sides and are co-extensive with the dovetail portions 10. Moreover, the holder is preferably elongated to effect dissipation of heat from the high temperature end 12 thereof. Moreover, the holder 2 is preferably formed as a single extruded piece of thermal shock resistant ceramic material, such as the material sold by Maryland Ceramic & Steatite Company, Bel Air, Maryland, under the name "Cordierite". Such material is reasonably hard and strong and is capable of withstanding thermal shock and temperatures in excess of 2000° F.

Figure 9:
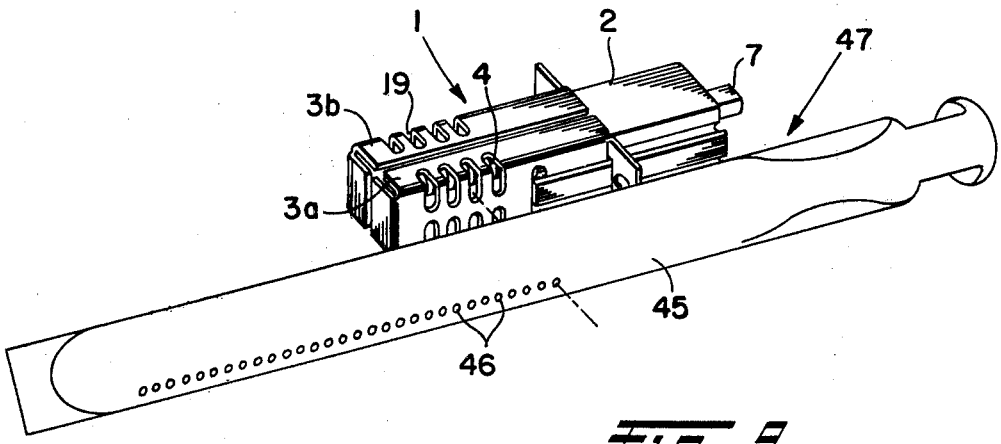
FIG. 9 is an isometric view illustrating the positioning of the igniter assembly with respect to a gas burner.

The shield 3 is preferably formed of two identical parts 3*a*, 3*b* for convenience of manufacturing and assembling the same with respect to the holder 2; however, if desired, the shield may be formed as a unitary structure. The shield should have suitable strength and heat and scale resistance characteristics to provide protection for the igniter. Moreover, if the shield 3 is formed of two parts 3*a*, 3*b*, as shown, and if the igniter assembly is positioned with a side next to a gas burner 45 as illustrated in FIG. 9, the shield part 3*a* may be formed, for example, from relatively expensive, strong, heat and scale resistant sheet material, such as stainless steel sold under the identification "Inconel 601", since at least a portion of that shield part is directly in the burner flame. The shield part 3*b* remote from the flame may be of a less expensive stainless steel, such as that designated commonly "18-SR". Also, if desired, the shield 3 may be formed of a ceramic material, for example, similar to that of the holder 2.

Each of the shield parts 3*a*, 3*b* may be individually stamped and/or cut to provide the holes or cut outs and folds in the configuration generally as illustrated. A longitudinal slot 13 in the shield terminates at a wall defining a somewhat smaller transverse slot 14. The width of the longitudinal slot 13 permits the shield to be slid onto the holder 2 with the longitudinal slot and the side walls of the holder dovetail portion 10 cooperating to guide the shield into proper position with respect to the holder. If desired, the width of the longitudinal slot 13 may be sufficiently small, so that the shield is actually force fitted onto the holder 2 with the shield walls bounding the longitudinal slot and the angular side walls of the holder dovetail with the shaped portions 10 cooperating for firm retention of the shield on the holder. The wall of the smaller slot 14 which defines the end of the longitudinal slot 13 preferably comes to abutment with the holder 2, and a quantity of ceramic insulating cement 15, or similar material, may be applied in the slot 14 and over a surrounding portion of the shield to secure permanently the shield to the holder. If desired, the cement may be applied between the shield along the slot 13 and the dovetail shape portion 10.

The shield 3 has perpendicularly turned side walls 16 relative to the extent of the upper wall within which the longitudinal slot 13 is formed, and such side walls provide laterial guidance for the shield when assembling the same onto the holder 2. Such side walls 16 also increase the effective strength of the shield. A mounting flange 17 has one or more screw holes 18 therein for attachment of the igniter assembly 1, to a support, such as for example the metal liner of an oven or other appliance, proximate a gaseous fuel to effect ignition of fuel as supplied to the burner.

A plurality of ports 19 in the shield 3 permit transfer of heat generated by the igniter for ignition of the fuel. The size, shape and number parameters of the ports 19 are designed to provide sufficient heat transfer to achieve such fuel ignition while the solid portions of the shield and a folder front flap portion 20 precludes direct access to the fragile igniter by most implements to protect the igniter from damage thereby.

The connector end 5 of the assembly 1 is illustrated more clearly in FIG. 2. The walls of the shield 3 bounding the longitudinal slot 13 can be seen just in engagement with the angular side walls of the holder dovetail shape portion 10. Also, the relative positions of the terminal tabs 6*a*, 6*b* and the spacer member 7 within the holder 8 is clearly illustrated.

As illustrated in FIGS. 3 through 6, the electrical subassembly of the igniter assembly 1 includes the igniter 4, the terminal tabs 6*a*, 6*b*, and a pair of electrical leads 30*a*, 30*b*, which may be Nichrome wire or the like capable of withstanding the temperatures to which the holder 2 is subjected during operation of the igniter assembly. Preferably, the electrical leads 30*a*, 30*b* are spot welded to respective terminal tabs and are attached to respective terminal parts 4*a*, 4*b* of the igniter 4 using a plasma or flame spraying technique as disclosed, for example, in the above referenced patent application. In such attachment arrangement, the igniter terminal portions 4*a*, 4*b*, which comprise the low temperature portion of the igniter, are of semi-cylindrical shape and have respective slots 31*a*, 31*b* cut therein to receive portions of the respective leads. Metallized coatings 32*a*, 32*b* are applied to the terminal parts about the inside and outside diameter portions thereof and to the portions of the electrical leads in the slots 31*a*, 31*b* for effective bonding of the leads to the terminal parts. Although it is preferable that the metallized coatings form a substantially complete cap on each of the igniter terminal parts for the most effective lead connection, a partial metallized coating or other means for attaching leads to the terminal parts also may be found satisfactory. An advantage to using the total capping technique is that the relatively ductile metallized coatings allow for some expansion and contraction of the igniter during heating and cooling thereof without peeling or flaking and, therefore, maintain effective electrical connection between the leads and igniter terminal parts.

Each of the terminal tabs 6*a*, 6*b* is preferably formed of stainless steel with first and second relatively flat portions 33 and 34 connected in offset relation to each other at a bend 35. Moreover, one or more holes 36 to reduce heat transfer and through which some ceramic insulating cement flows to enhance the mechanical connection of the terminal tabs to the holder 2 are formed in the first flat portion 33. The electrical leads 30*a*, 30*b* are preferably spot welded to the first flat portions 33 of the terminal tabs, although other attaching techniques may be used, and when so attached with respect to each other, the terminal tabs extend substantially parallel with respect to each other with the second flat portions 34 thereof being relatively further spaced apart than the first flat portions 33 thereof.

Figure 7:
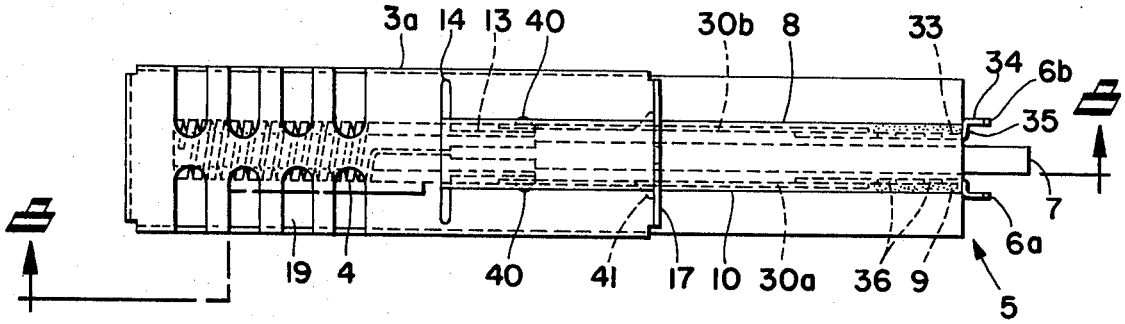
FIG. 7 is a top view of the igniter assembly illustrated in FIG. 1.
Figure 8:
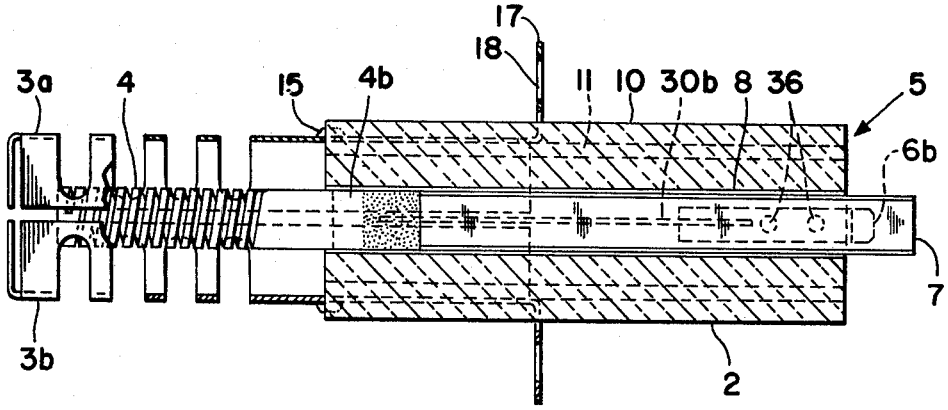
FIG. 8 is a side view of the igniter assembly broken away in section taken along the plane 8—8 of FIG. 7.

Turning now more particularly to FIGS. 7 and 8, the relationship of the electrical and mechanical subassemblies in the igniter assembly 1 is clearly depicted. Part of the low temperature portion of the igniter 4, including the terminal parts 4*a*, 4*b* is positioned within the bore 8 of holder 2, and the leads 30*a*, 30*b* extend along the bore to the respective connections to the terminal tabs 6*a*, 6*b*. The first more closely spaced flat portions 33 of the terminal tabs are substantially wholly located within the bore 8, and the second more widely spaced flat portions 34 and the bends 35 are located outside the holder and extend rearwardly therefrom. The offset arrangement of the two flat portions of the respective terminal tabs 6*a*, 6*b* facilitates proper positioning of the spacer member 7 therebetween to separate the same and the electrical leads 30*a*, 30*b* and facilitates effective connection to power terminals in an electrical receptacle or the like, not shown. The offset in the terminal tabs also provide the front to rear positioning of the igniter and because the offsets or bends 35 rest against the ceramic holder, a solid backup is provided when a push on terminal is installed.

The spacer member 7 preferably extends through the bore 8 into engagement with the terminal parts of the igniter 4, and a quantity of ceramic insulating cement 40 may be applied at the ends of the igniter terminal parts to secure the same in fixed position in the holder bore 8. If desired, such cement may be placed to fill part or all of the igniter, which may be hollow for such securing purpose and/or for strengthening the igniter. Also, if desired, an alumina spacer orthe like, not shown, may be inserted between the respective terminal parts 4*a*, 4*b* of the igniter 4 in the slot formed therebetween to ensure further electrical isolation of the same and/or for added strength.

The quantity of ceramic insulating cement 9 provided in the bore 8 at the connecting end 5 of the igniter assembly preferably only extends inwardly of the bore to a depth sufficient to fill both of the illustrated openings 36 in the first flat portions 33 of the terminal tabs 6*a*, 6*b* for firmly securing the terminal tabs and the spacer member 7 in permanent position within the holder 2. Also, it is noted that the ceramic insulating cement which is used to secure the shield 3 to the holder 2 is not illustrated in FIG. 7 in order that the preferred shape of the narrow slot 14 thereof can be seen.

To make the igniter assembly 1 the leads 30*a*, 30*b* are attached to the igniter terminal parts 4*a*, 4*b* and to the terminal tabs 6*a*, 6*b*, thus forming the electrical subassembly. A quantity of ceramic insulating cement is applied to the end of the igniter terminal parts, and the terminal tabs, leads and igniter then are inserted in position in the bore 8 of the holder 2. The spacer member 7 is inserted between the terminal tabs through the bore 8 preferably to a position in abutment with the igniter 4, and the ceramic insulating cement 9 is applied to the bore at the connecting end 5 of the igniter assembly to secure the elements thereof in permanent position.

Each of the shield parts 3*a*, 3*b* has a chamfer 41 to facilitate its sliding onto the holder 2 along the dovetail shape portion 10, and after the electrical subassembly is secured in the holder 2 and the shield parts are slid into such position, the ceramic insulating cement 15 is applied to secure the mechanical subassembly.

In the described assembled configuration, there is preferably a minimum of ¼ inch clearance all around the igniter 4 relative to the shield 3. The igniter assembly 1 may be mounted, for example, in an oven or the like taking advantage of the positioning guidance provided by the portion of the spacer member 7 that extends externally of the holder 2 to ensure proper electrical connection of the terminal tabs 6*a*, 6*b* in an electrical receptacle, and the assembly may be attached to an oven liner or the like by mounting screws located in the screw holes 18 in the mounting flange 17.

The igniter assembly 1 is preferably located in position with respect to a conventional gas burner 45, as shown in FIG. 9, such that at least one or more of the shield ports 19 are adjacent several of the burner ports 46 and preferably proximate the burner inlet end 47. Therefore, when the igniter is energized, heat generated thereby will be effective to ignite the gas or gas-air mixture issuing from the burner ports.

More specifically, in operation of the igniter assembly 1, electric power provided to the igniter 4 from the terminal tab 6*a*, 6*b* via the leads 30*a*, 30*b* causes the high temperature portion of the igniter to heat to the temperature of approximately 1800° F. to 2700° F. When the igniter assembly is used to ignite a gas fuel, for example, a mixture of gas and air passes proximate the shield or, if desired, through the ports 19 thereof, for ignition by the heat generated by the igniter 4. Moreover, during such energization of the igniter, the relatively poor thermal conductivity of the holder 2 maintains the connecting end 5 of the igniter assembly relatively cool. It is noted that the igniter assembly 1 if of a wattage sufficient for the purpose can first, appreciably supplement the burner heat and itself act as a heat source to maintain a relatively warm temperature in an oven, for example, to keep already cooked foods at a warm temperature ready for serving or to facilitate in the defrosting of frozen foods.

Figure 10:
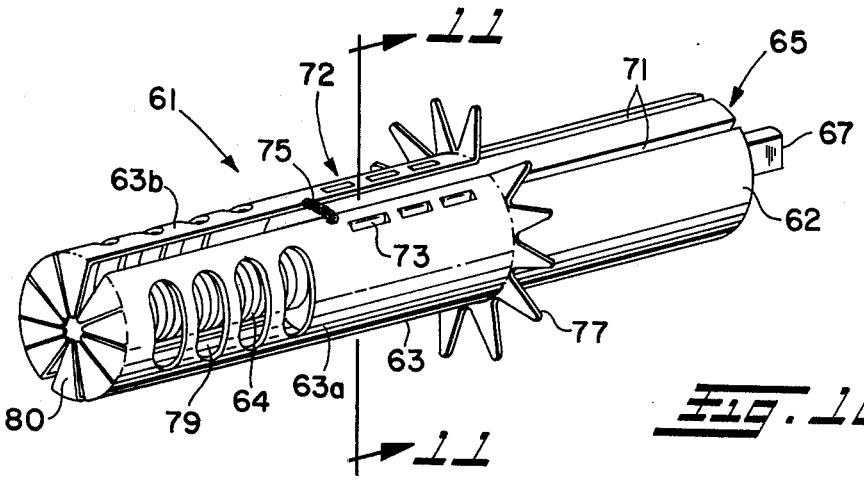
FIG. 10 is an isometric view of a modified igniter assembly in accordance with the invention.

A modified igniter assembly generally designated 61 in FIG. 10 is of generally overall cylindrical configuration as opposed to the overall rectangular configuration of the igniter assembly 1 described above. Both igniter assemblies 1 and 61 are formed preferably of similar materials and are usable in the same manner, as described above with reference specifically to the igniter assembly 1.

Figure 11:
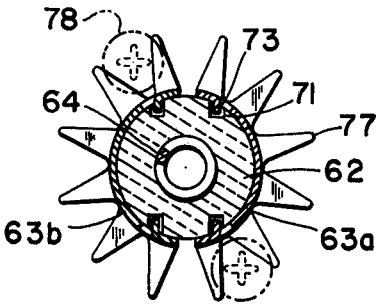
FIG. 11 is a section view of the modified igniter assembly looking in the direction of the plane indicated by the arrows 11—11 of FIG. 10.

As shown most clearly in FIGS. 10 and 11, the modified igniter assembly 61 includes a substantially cylindrical ceramic holder 62, a shield 63 attached thereto and a glow type electric igniter 64, which is illustrated as a silicon carbide type but may be of the molybdenum disilicide type or other type. The holder 62 is preferably substantially solid and has an internal longitudinal bore or passageway within which a portion of the igniter 64 is cemented, through which respective electrical leads pass in electrically isolated relation separated by an insulating spacer member 67, and from which a pair of tab terminals extend at the connecting end 65 in a manner substantially identical with the arrangement described above with reference to FIGS. 1 through 9 concerning the igniter assembly 1.

The shield 63 is preferably formed in two parts 63*a*, 63*b* for convenience of manufacture and for reduction in cost of the igniter assembly, whereby the shield 63*a* is formed of a higher or more temperature and scale resistant material than the shield part 63*b*, as described above with regard to the shield parts 3*a*, 3*b*. The shield, of course, also may be formed of a single part. Four parallel grooves 71 extend longitudinally along the surface of the holder 62 for connection of the shield 63 to the holder 62, which is preferably elongated to effect dissipation of heat from the high temperature end 72 thereof.

Each of the shield parts 63*a*, 63*b* is preferably identical with the possible exception of the material comprising the same, and each includes a number of folded down ears or tabs 73 that slide in respective grooves 71 of the holder 62 for attachment of the shield parts to the holder. The ears 73 may be folded to an extent that the respective shield part slides easily onto the holder 62, or, if desired, the ears may be only partially bent to an extent that they at least slightly bite into the ceramic material forming the grooves 71 for relatively firm retention of the respective shield parts on the holder. Also, a quantity of ceramic cement 75 may be applied further to secure the shield 63 to the holder 62.

At the rearward end of the shield 63 a number of outwardly folded triangular-shape fingers or protrusions 77 protrude for mounting of the igniter assembly 60, for example, on the sheet metal wall of an oven by screws 78 shown in FIG. 11. Preferably, the distance between the fingers 77 and a high temperature portion of the igniter 64 and the high temperature end 72 of the igniter assembly is equal to the distance from the first one or several gas burner ports to the sheet metal wall of the oven so that the fingers 77 facilitate proper depth positioning of the igniter assembly 61 with respect to the gas burner in the oven. Moreover, if desired, a stop, not shown, may be provided either on the shield parts or on the holder 62 for accurate positioning of the former on the latter such that the fingers 77 will be at a proper location for ease of assembly with respect to an oven.

Figure 12:
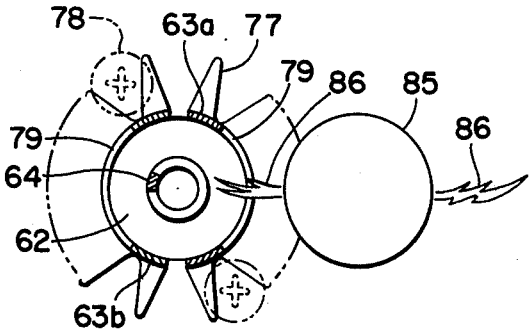
FIG. 12 is a schematic view in elevation of the igniter assembly, which is seen from just inside the forward end of the shield, positioned with respect to a gas burner.

A number of ports 79 in the shield parts 63*a*, 63*b* at the high temperature end 72 of the igniter assembly 61 are of a size, shape and number to provide sufficient heat transfer from the igniter to ignite a fuel, and to that end the relative positions of the igniter assembly and a schematically illustrated conventional gas burner 85 is depicted in FIG. 12. Moreover, at the forwardmost end of the shield 3 a plurality of triangular-shape fingers or protrusions 80 are folded inwardly substantially enclosing the front end portion thereof to preclude direct access to the fragile igniter 64 by most implements, thus further protecting the igniter from damage thereby.

In using the modified igniter assembly 61, the latter is positioned with respect, for example, to a conventional gas burner 85, as illustrated in FIG. 12, to ignite fuel therefrom. As shown in the figure, the fuel has already been ignited, and respective flames 86 are jetting outwardly from respective ports in the burner. Operation of the modified igniter assembly 61 is substantially identical with the operation of the igniter assembly 1 described above.

The cylindrical shape of the holder 62 of the modified igniter assembly 61 requires somewhat less ceramic material for extrusion thereof relative to the material required for the holder 2 illustrated, for example, in FIG. 1. Similarly, the quantity of material required to form the shield 63 of the modified igniter assembly 61 is somewhat less than quantity of material required to form the shield 3 of the igniter assembly 1. Thus, at the least the modified igniter assembly is clearly a potential improvement to the igniter assembly in respect of the cost of materials, without constituting a departure insofar as the function is concerned.

Figure 13:
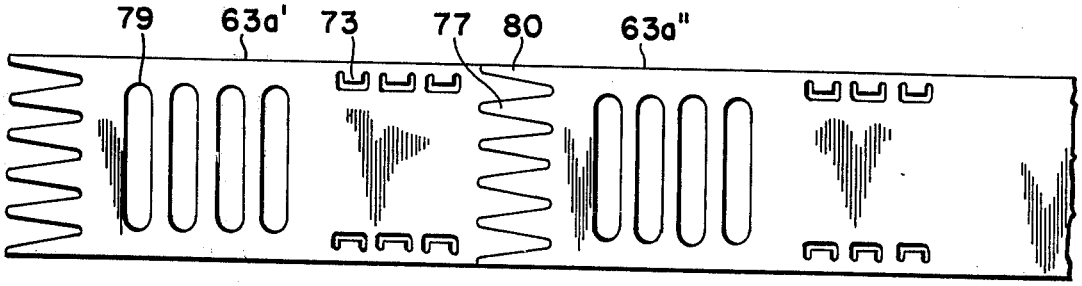
FIG. 13 is a plan view of stamped sheet material forming parts of the shield of the igniter assembly.

Furthermore, with reference to FIG. 13, two shield parts formed of the same material, such as the shield part 63*a'* and 63*a''* for two individual modified igniter assemblies 61, may be stamped sequentially from a common strip of sheet material with minimum material waste. In particular, a single stamping process may effect cutting out of the ports 79, cutting out about the ears 73 and/or folding the same, and cutting out both the fingers 77 of the leading shield parts 63*a'* as well as the finger 80 of the trailing shield part 63*a''*, which also serves to separate both shield parts.

It should now be readily apparent that the igniter assembly of the invention provides an efficiently assembled and effective mounting and protective structure for an electric igniter.

The embodiments of the invention in which an exclusive property or privilege is claimed are defined as follows:

1. An igniter assembly, comprising an electric resistance igniter element having relative high and low temperature portions, discrete spaced apart terminal parts connected to the latter portion for connection to a source of electric energy, electrically conductive means for connecting said terminal parts to a source of electric energy for energization of said electric resistance igniter element, an electrically non-conductive holder means for supporting said electric resistance igniter element, said holder means having opposite ends, means for directly mechanically connecting said low temperature portion of said electric resistance igniter element to said holder means proximate one end of the latter, said holder means having interior passageway means for directing said electrically conductive means through said holder means for connection to a source of electric energy, at least a portion of said electric resistance igniter element low temperature portion extending into said interior passageway means of said electrically non-conductive holder means, and shield means secured to said holder means and extending beyond said one end over at least a substantial portion of said electric resistance igniter element high temperature portion for shielding at least a portion of the latter.

2. An igniter assembly as set forth in claim 1, wherein said electrically non-conductive holder means comprises a substantially solid piece of ceramic material.

3. An igniter assembly as set forth in claim 1, wherein said means for directly mechanically connecting comprises electrically non-conductive cement-like means for bonding said electric resistance igniter element and said holder means together.

4. An igniter assembly as set forth in claim 1, wherein said electrically conductive means comprises a pair of electrical leads respectively connected to said electric resistance igniter element terminal parts, said electrical leads and their respective connections to said electric resistance igniter element terminal parts being located solely in said interior passageway means, and said electrically conductive means further comprising a pair of electrical terminals, each being connected to a respective electrical lead to provide a connection exteriorly of said holder means from such source of electric energy to said electric resistance igniter element terminal parts.

5. An igniter assembly as set forth in claim 4, further comprising means in said interior passageway means for electrically isolating said electrical terminals one from the other.

6. An igniter assembly as set forth in claim 1, wherein said electrically non-conductive holder means includes at least one raised prismatic-shape portion on an external surface thereof extending generally parallel to at least a portion of said interior passageway means, and said shield means includes longitudinal slot means cooperable with said prismatic-shape portion for attaching said shield means to said electrically non-conductive holder means.

7. An igniter assembly as set forth in claim 6, wherein said prismatic-shape portion comprises a dovetail-shape portion.

8. An igniter assembly as set forth in claim 6, further comprising means for cementing said shield means to said electrically non-conductive holder means.

9. An igniter assembly as set forth in claim 6, wherein said at least one raised prismatic shape portion includes a pair of opposed raised prismatic shape portions on opposite surfaces of said electrically non-conductive holder means, and said shield means includes two such longitudinally extending slot means, each cooperating with a respective one of said prismatic shape portions.

10. An igniter assembly as set forth in claim 9, wherein said shield means comprises two substantially identically formed parts, each having a respective one of said longitudinally extending slot means formed therein, and further comprising means for cementing each of said shield parts to said electrically non-conductive holder means.

11. An igniter assembly as set forth in claim 1, wherein said igniter assembly has an overall external configuration of generally rectangular shape.

12. An igniter assembly, comprising an electric resistance igniter element having relative high and low temperature portions, discrete spaced apart terminal parts connected to the latter portion for connection to a source of electric energy, electrically conductive means for connecting said terminal parts to a source of electric energy for energization of said electric resistance igniter element, an electrically non-conductive holder means for supporting said electric resistance igniter element, said holder means having interior passageway means for directing said electrically conductive means through said holder means for connection to a source of electric energy, at least a portion of said electric resistance igniter element low temperature portion extending into said interior passageway means of said electrically non-conductive holder means, said electrically conductive means including terminal means protruding beyond said passageway means in exposure for external circuit connection, means between said terminal means for electrically isolating the latter, means for bonding said terminal means and said means for electrically isolating in fixed position relative to said holder means, and shield means secured to said holder means and extending over at least a substantial portion of said electric resistance igniter element high temperature portion for shielding at least a portion of the latter.

13. An igniter assembly as set forth in claim 12, wherein said interior passageway means comprises a single passage, said electrically conductive means includes lead means in said passage for electrically connecting said terminal parts to said respective terminal means, and said means for electrically isolating comprises an electrically non-conductive spacer member extending between said lead means and between said terminal means to abutment with said electric resistance igniter element, and a portion of said spacer member extending externally of said passage.

14. An igniter assembly, comprising an electric resistance igniter element having relative high and low temperature portions, discrete spaced apart terminal parts connected to the latter portion for connection to a source of electric energy, electrically conductive means for connecting said terminal parts to a source of electric energy for energization of said electric resistance igniter element, an electrically non-conductive holder means for supporting said electric resistance igniter element, said holder means having interior passageway means for directing said electrically conductive means through said holder means for connection to a source of electric energy, at least a portion of said electric resistance igniter element low temperature portion extending into said interior passageway means of said electrically non-conductive holder means and shield means secured to said holder means and extending beyond an end thereof over at least a substantial portion of said electric resistance igniter element high temperature portion for shielding at least a portion of the latter to block external objects from engagement therewith, said shield means including opening means therein for substantially exposing said electric resistance igniter element high temperature portion to provide sufficient heat transfer from the latter to effect ignition of a fuel.

15. An igniter assembly as set forth in claim 14, wherein said opening means in said shield means comprises a plurality of ports in the latter.

16. An igniter assembly as set forth in claim 15, wherein said shield means comprises means for mounting the igniter assembly to an external support.

17. An igniter assembly as set forth in claim 15, wherein said shield means comprises two substantially identically shaped parts, one of said parts being positionable facing a fuel burner for direct exposure to a flame therefrom and comprising high temperature and scale resistant material, and the other part being positionable out of direct exposure to such flame and comprising relatively lower temperature and scale resistant material.

18. An igniter assembly as set forth in claim 15, wherein said shield means is positioned about substantially all of the high temperature portion of said electric resistance igniter element.

19. An igniter assembly as set forth in claim 14, wherein said holder means has a plurality of longitudinal grooves in the external surface thereof, and said shield means includes means cooperable with said grooves for retention on said holder means.

20. An igniter assembly as set forth in claim 19, wherein said means cooperable comprises a plurality of tabs folded in a direction toward said passageway means, said tabs being slidably received in said grooves upon assembly of said shield means to said holder means.

21. An igniter assembly as set forth in claim 14, wherein said igniter assembly has a generally cylindrical configuration, and said shield means has a plurality of triangular-shape protrusions at the forward end thereof, said protrusions being folded inwardly toward the axis of the cylindrically configured igniter assembly.

22. An igniter assembly as set forth in claim 21, wherein said shield means has a plurality of triangular-shape protrusions at the rearward end thereof, said protrusions being folded outwardly from the axis of the cylindrically configured igniter assembly, said protrusions providing for mounting of said igniter assembly to a supportive structure.

23. An igniter assembly, comprising an electric resistance igniter element having relative high and low temperature portions, discrete spaced apart terminal parts connected to the latter portion for connection to a source of electric energy, electrically conductive means for connecting said terminal parts to a source of electric energy for energization of said electric resistance igniter element, metallized coating means for attaching said electrically conductive means to said respective spaced apart terminal parts, an electrically non-conductive holder means for supporting said electric resistance igniter element, said holder means having opposite ends, means for connecting said low temperature portion of said electric resistance igniter element to said holder means proximate one end of the latter, said holder means having interior passageway means for directing said electrically conductive means through said holder means for connection to a source of electric energy, the area of such connection of said metallized coating means, said electrically conductive means, and said terminal parts being positioned within said interior passageway means of said holder means, and shield means secured to said holder means and extending beyond said one end over at least a substantial portion of said electric resistance igniter element high temperature portion for shielding at least a portion of the latter.

24. An igniter assembly as set forth in claim 23, wherein said electric resistance igniter element has the electrical and thermal properties of silicon carbide.

25. An igniter assembly as set forth in claim 24, wherein said electric resistance igniter element comprises silicon carbide.

26. An igniter assembly as set forth in claim 23, wherein said means for connecting comprises electrically non-conductive cement-like means in said interior passageway means for directly mechanically securing said electric resistance igniter element and said holder means together.

* * * * *